US005794681A

United States Patent [19]

Oda et al.

[11] Patent Number: 5,794,681

[45] Date of Patent: Aug. 18, 1998

[54] MOLDING MACHINE

[75] Inventors: Shigeo Oda; Kazuharu Matsui, both of Toyokawa; Ryoji Kanayama, Toyohashi; Kuniyasu Mori; Kazuo Sugimoto, both of Toyokawa; Kimikazu Kaneto, Toyohashi, all of Japan

[73] Assignee: Sintokogio, Ltd., Nagoya, Japan

[21] Appl. No.: 868,442

[22] Filed: Jun. 3, 1997

[30] Foreign Application Priority Data

Jun. 7, 1996 [JP] Japan ..... 8-168345
Mar. 7, 1997 [JP] Japan ..... 9-070467

[51] Int. Cl.[6] ..... B22C 15/02; B22C 15/28

[52] U.S. Cl. ..... 164/195; 164/37; 164/38; 164/201; 164/207

[58] Field of Search ..... 164/195, 201, 164/187, 194, 207, 37, 38

[56] References Cited

U.S. PATENT DOCUMENTS 3,736,978 6/1973 Taccone ..... 164/187
4,030,535 6/1977 Saka ..... 164/187 X
4,230,172 10/1980 Uzaki et al. ..... 164/195 X
4,781,236 11/1988 Uzaki et al. ..... 164/195 X
5,660,221 8/1997 Oda et al. ..... 164/195 X

FOREIGN PATENT DOCUMENTS 56-39147 4/1981 Japan ..... 164/195
63-21577 5/1988 Japan .
4-28453 1/1992 Japan .

*Primary Examiner*—J. Reed Batten, Jr.
*Attorney, Agent, or Firm*—Limbach & Limbach L.L.P.

[57] ABSTRACT

The machine includes a lifter table for lifting a pattern plate and flask which hold molding sand and a pre-compacting member and a pressing member disposed above the lifter table for horizontal movement and for being inserted into the flask when the lifter table lifts the flask. The pre-compacting member includes a thin-plate body to be positioned slightly spaced apart from an inner surface of the flask or inner and outer surfaces of a pattern when inserted into the molding sand held in the flask. The pressing member includes a squeezing body that presses the molding sand from above.

11 Claims, 7 Drawing Sheets

MOLDING MACHINE

FIELD OF THE INVENTION

This invention relates to a molding machine for producing a mold by pressing molding sand fed into a space defined by a pattern plate and a flask.

DESCRIPTION OF THE PRIOR ART

In producing a mold by a molding machine by pressing molding sand in a flask, a part of the molding sand is not put into a flask when it is supplied to it. Further, the molding sand in a flask tends not to be dense at parts, especially, at a lower peripheral part near the inner surfaces of the flask, between patterns, near a pocket of a pattern, and near inner and outer surfaces of a pattern.

This is caused because molding sand tends not be well charged at the part near the inner surfaces of the flask, and because a force to press the molding sand is not well transmitted to its lower part near the surfaces of the flask, pocket, and patterns, due to frictional resistance of the surfaces when the molding sand is pressed. A mold having a part or parts that are not dense tends to deform, particularly when it is filled with molten metal. Thus it fails to produce a good cast of accurate dimensions. Conventionally, before pressing all the molding sand, pre-compacting it by the jolt process, by circulating compressed air through the molding sand, and by long rods which extend from the periphery of the bottom of a press plate, have been tried.

However, if molding sand in a flask is jolted for pre-compaction, the molding machine produces vibrations and noises by the impacts, and the machine must be a durable and heavy-duty one to resist the impacts. If compressed air is used to be passed through the molding sand for the pre-compaction, the molding machine requires durable pneumatic equipment and air-sealing devices. Thus the machine and the equipment will be bulky. If long rods which extend from the periphery of the bottom of a press plate are used to press molding sand at a part near the inner surface of a flask, the molding sand at the other parts, where the rods are not used, tends not to be well consolidated.

Japanese Patent KOKOKU (B) 63-21577 discloses a machine to press molding sand. This machine has a plurality of cylinders with piston rods, which are inserted into molding sand for pre-compacting it. The device also has a squeeze plate to press all the molding sand after the piston rods are withdrawn from it. The machine is complicated and bulky.

Japanese Patent KOKAI (A) 4-28453 discloses a method to sequentially pre-compact many parts of molding sand by a single pressing rod which is programmed to sequentially move to the parts, and then to press all the molding sand by a squeeze member. A machine that executes this method will be also complicated, and such a machine takes a long time to pre-compact the molding sand at many parts.

This invention is conceived in view of the above prior-art drawbacks. It aims to provide a molding machine for producing a mold which is well consolidated at all the parts. This invention also aims to provide such a machine which can supply molding sand into a flask without dropping molding sand from the flask.

SUMMARY OF THE INVENTION

To the above end, in one aspect a molding machine of the present invention for producing a mold by pressing molding sand fed into a space defined by a pattern plate and a flask includes a lifter table for lifting the pattern plate and flask which hold the molding sand, and a pre-compacting member and a pressing member disposed above the lifter table for horizontal movement and for being inserted into the flask when the lifter table lifts the flask, wherein the pre-compacting member includes a thin-plate body to be positioned slightly spaced apart from an inner surface of the flask or inner and outer surfaces of a pattern when inserted into the molding sand held in the flask, and wherein the pressing member includes a squeezing body that presses the molding sand from above.

In another aspect of the present invention, a molding machine for producing a mold by feeding molding sand into a space defined by a pattern plate and a flask and pressing it includes a blow head for feeding molding sand by compressed air into the space, a raising table for raising the flask to have it engage the blow head to close the space, a lifter table for lifting the pattern plate and flask which hold the molding sand, and a pre-compacting member and a pressing member disposed above the lifter table for horizontal movement and for being inserted into the flask when the lifter table lifts the flask, wherein the pre-compacting member includes a thin-plate body to be positioned slightly spaced apart from an inner surface of the flask or inner and outer surfaces of a pattern when inserted into the molding sand held in the flask, and wherein the pressing member includes a squeezing body that presses the molding sand from above.

DESCRIPTION OF THE PREFERRED EMBODIMENT

The preferred embodiment of the molding machine of the present invention will now be explained by reference to the accompanying drawings.

Figure 1:
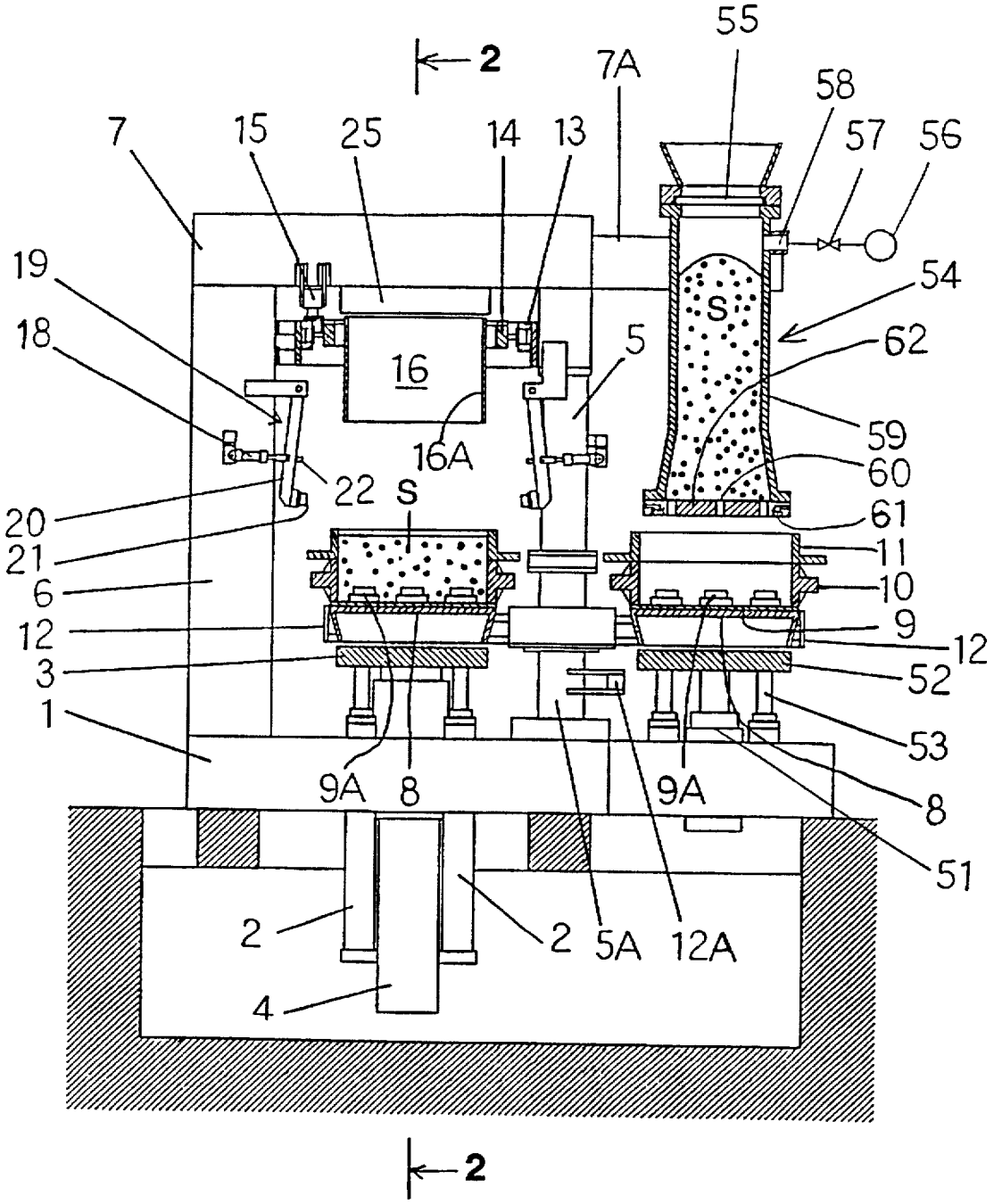
FIG. 1 is a partly cross-sectional front view of an embodiment of the molding machine of the present invention.
Figure 2:
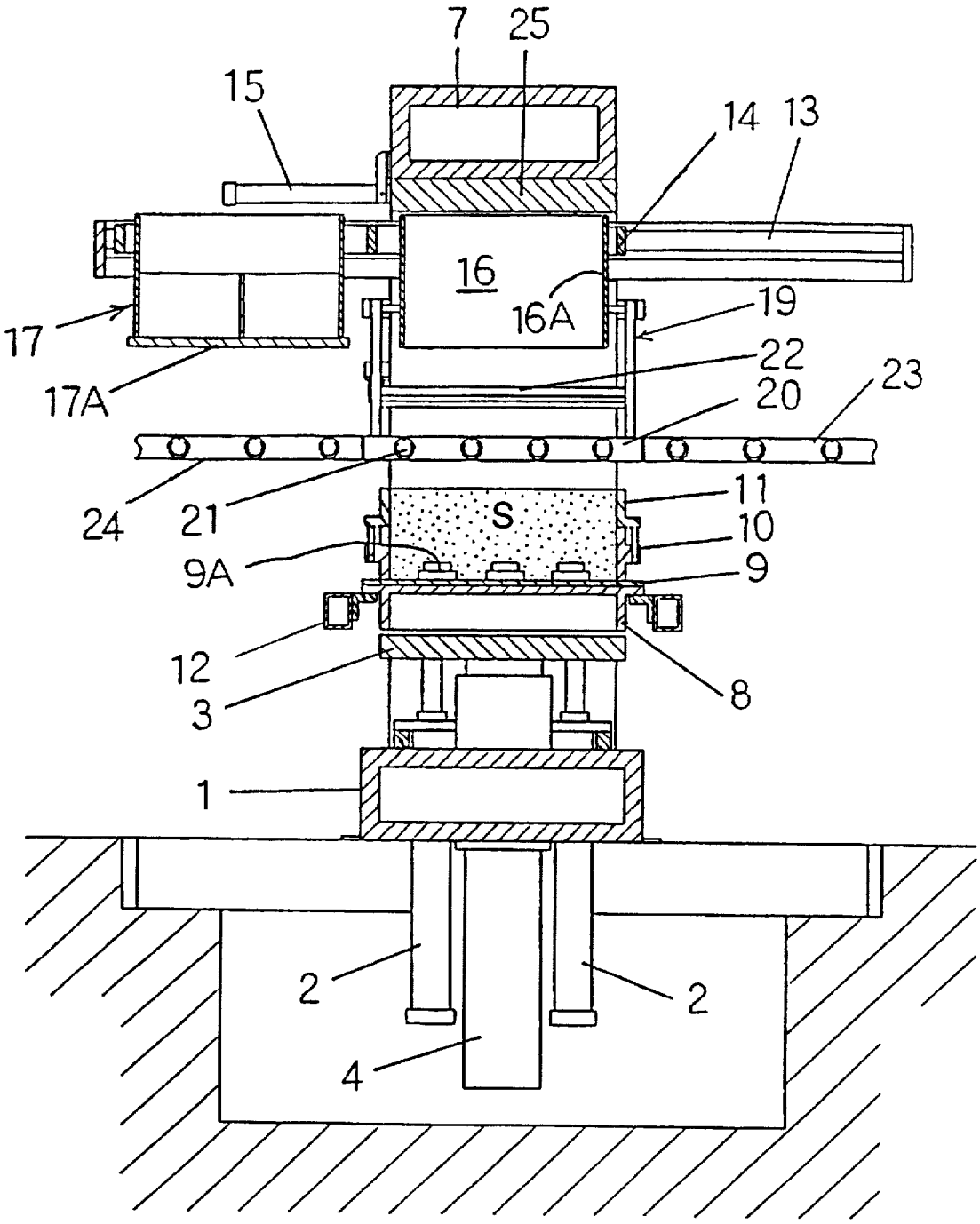
FIG. 2 is a cross-sectional view along line A—A in FIG. 1.

As in FIGS. 1 and 2, four upwardly-facing cylinders 2, 2 are mounted on a left, central part of a base 1 (FIG. 1). A lifter table 3 is secured to the ends of the piston rods of the cylinders 2, 2. A guide rod 4 is disposed under the central part of the lifter table 3 such that it is kept horizontal when it is vertically guided. A column 5, which has a pivotable shaft 5A at its lower end, and a support 6, are mounted on the base 1 such that they are located on either side of the lifter table 3. The top of the column 5 and the top of the support 6 are connected by a ceiling frame 7. A frame 12 is rotatably attached to the pivotable shaft 5A. The rotary frame 12 has two carriers 8, 8, one on each side. An assembly of a pattern plate 9, to which a pattern or patterns 9A are attached, a flask 10, and a filling frame 11, is mounted on each carrier 8. The shaft 5A is pivoted by a rotating cylinder 12A, which is mounted on the base 1, such that the two assemblies on the frame 8 are rotated and intermittently indexed above the lifter table 3.

A pair of opposing rails 13, 13, for a truck 14, are securely attached to the upper parts of the column 5 and support 6 so that the truck 14 can reciprocally travel along the rails 13, 13 by means of a running cylinder 15 which is mounted on the ceiling frame 7 and connected to the truck 14. As in FIG. 2, a pre-compacting member 16 and pressing member 17, which are horizontally spaced apart, are suspended from the truck 14 through collars (not shown) such that they are free to move vertically. The pre-compacting member 16 includes a thin-plate body 16A comprised of thin plates, which extend downward, and which are to be inserted into the molding sand S held in the flask 10 at a part slightly spaced from the inner surfaces of the flask 10 in the manner described below. The pressing member 17 includes a squeezing body 17A, which is to be inserted into the flask 10 to press all the molding sand S from above.

A linkage mechanism 19 (i.e., an openable roller conveyor) is attached to the column 5 and support 6. The mechanism 19 is disposed above the lifter table 3 and between the column 5 and support 6. The openable roller conveyor 19 includes cylinders 18, 18 mounted on the column 5 and support 6, a pair of roller frames 20, 20 to be opened or closed by the cylinders 18, 18, rollers 21, 21 mounted on the roller frames 20, 20, and a pair of receiving members 22, 22 mounted vertically midway of the linkage 19 for receiving the filling frame 11. The inner ends of the receiving members 22, 22 are located outside those of the rollers 21, 21. Roller conveyors 23, 24 (FIG. 2) for carrying flasks are disposed at the front and back of the openable roller conveyor 19. A stopper 25 is secured to the bottom of the ceiling frame 7 to receive the pre-compacting member 16 or pressing member 17 when the member is moved upward.

Further, an upwardly-facing cylinder 51 is mounted on a right portion (FIG. 1) of the base 1. A raising table 52 is attached to the end of the piston rod of the cylinder 51. Further, guide rods are disposed under the raising table 52 to guide the table for vertical movement while keeping it horizontal. A fixing frame 7A extends from the ceiling frame 7, and it suspends a blow head 54. The blow head 54 and the raising table 52 are sufficiently spaced apart so that the rotary frame 12 and an assembly of a pattern plate 9, a flask 10, and a filling frame 11, can pass between them. The blow head 54 has a gate 55 through which molding sand is fed into it. The blow head 54 is comprised of a hollow cylinder 59 and a blow plate 62 to close the bottom opening of the hollow cylinder 59. An air-introducing port 58 is formed at an upper part of the hollow cylinder 59 so that the blow head can be in fluid communication with a compressed-air supply source 56 through a valve 57. The blow plate 62 for closing the hollow cylinder 59 is formed with sand-feeding throughbores 60 and vent holes 61 provided with vent plugs for allowing introduced air to escape from them.

In operation the lifter cylinders 2, 2 are actuated to raise the lifter table 3, and therefore lift the assembly which holds the molding sand S on the rotary frame 12. Accordingly, the molding sand S contacts the lower end of the thin-plate body 16A of the pre-compacting member 16. Thus the pre-compacting member 16 floats from the truck 14 and is pressed against the stopper 25. The lifter table 3 is raised until the lower end of the thin-plate body 16A enters the molding sand and comes to a position slightly above the pattern plate 9 (as in FIG. 3). As explained below, during this process molding sand is fed to another assembly on the rotary frame 12. Since the thin-plate body 16A is inserted into the molding sand S, it is well pre-compacted at the peripheral part near the inner surfaces of the flask 10. Thus the bulk density of the molding sand S becomes high.

Figure 4:
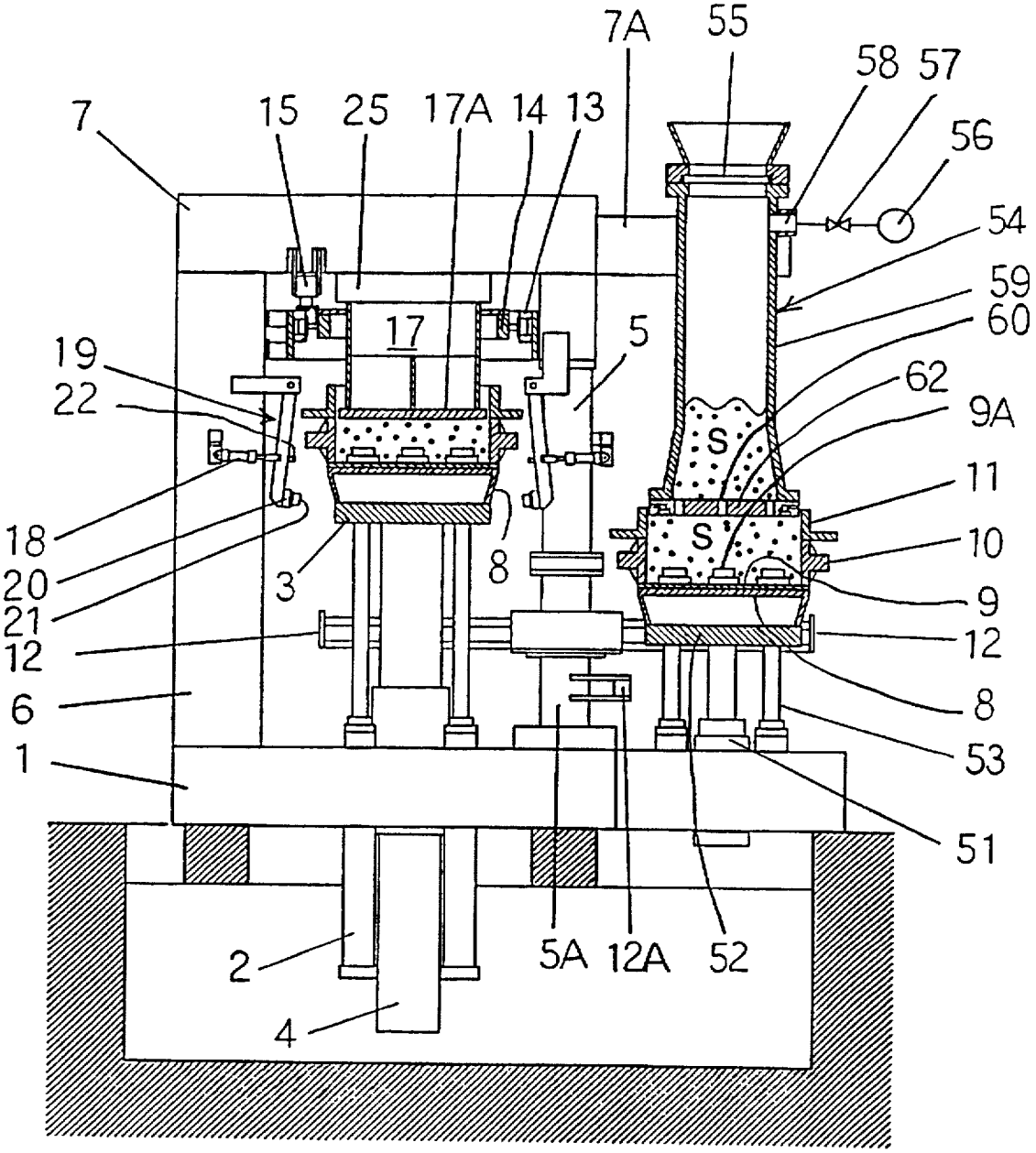
FIG. 4 is a view similar to FIG. 3, showing the molding sand being pressed.

The lifter cylinders 2, 2 are then retracted to lower the assembly, and then stop when the thin-plate body 16A is withdrawn from the molding sand. The running cylinder 15 is then activated to move the truck 14 rightward in FIG. 2 to index the pressing member 17 just above the flask 10. The lifter cylinders 2, 2 are then activated to raise the assembly so that the squeezing body 17A enters the filling frame 11 and contacts the molding sand S held by it. The pressing member 17 is pressed against the stopper 25, and thus the squeezing body 17A presses or squeezes all the molding sand from above. The squeezing body 17A reaches the bottom of the filling frame 11. Thus the molding sand is well consolidated, and a mold is produced (FIG. 4).

Figure 5:
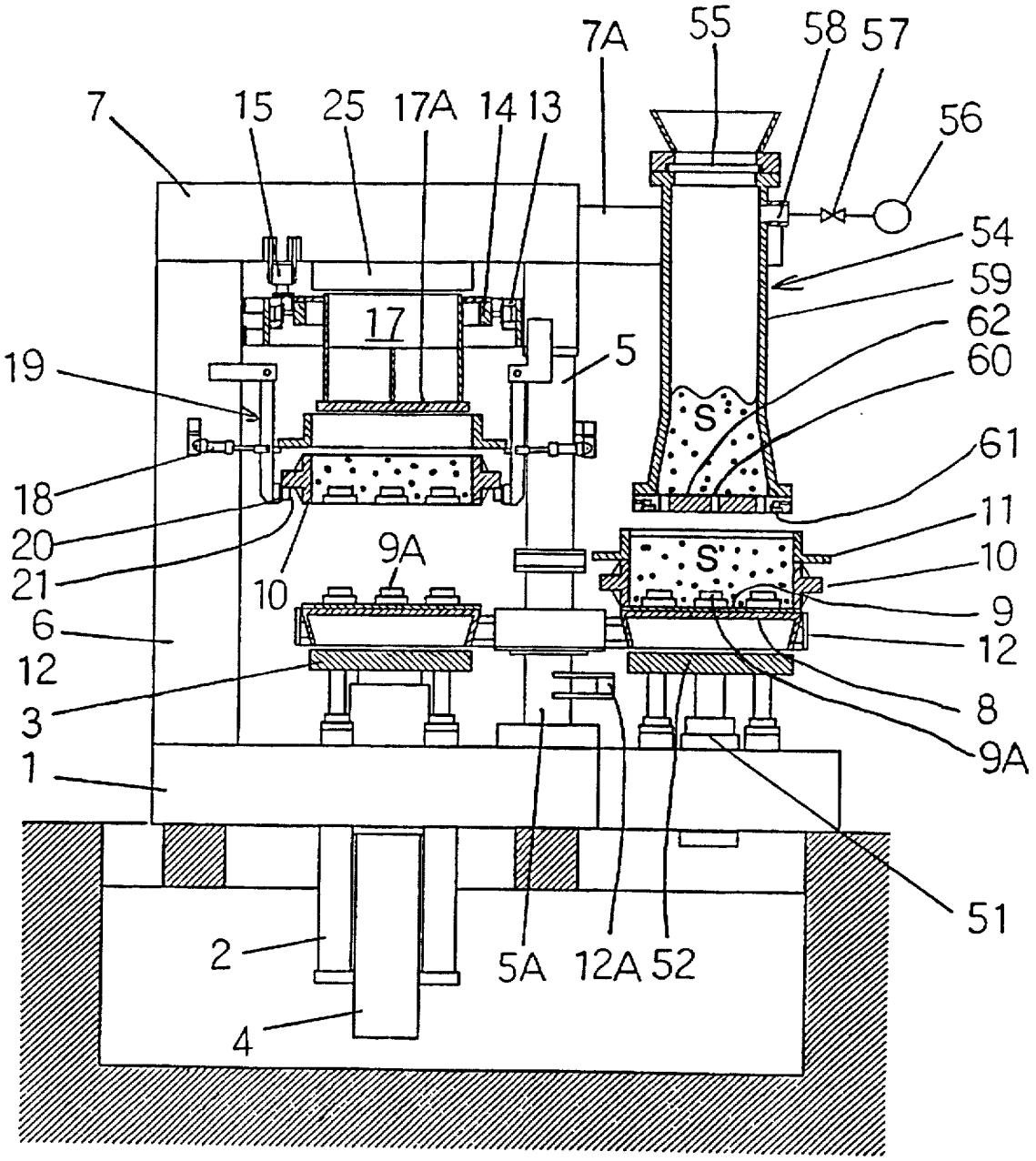
FIG. 5 is a view similar to FIG. 4, showing a pattern being drawn.

The cylinders 18, 18 of the linkage mechanism 19, or roller conveyor, are activated to close it, and the lifter table 3 is then lowered to the position shown in FIG. 5 (or FIG. 1). As is clear from FIG. 5, while the squeezing body 17A is withdrawn from the filling frame 11 and the filling frame is received by the members 22, 22, the flask 10, which holds the produced mold, is received by the rollers 21, 21 of the roller conveyor 19.

Figure 3:
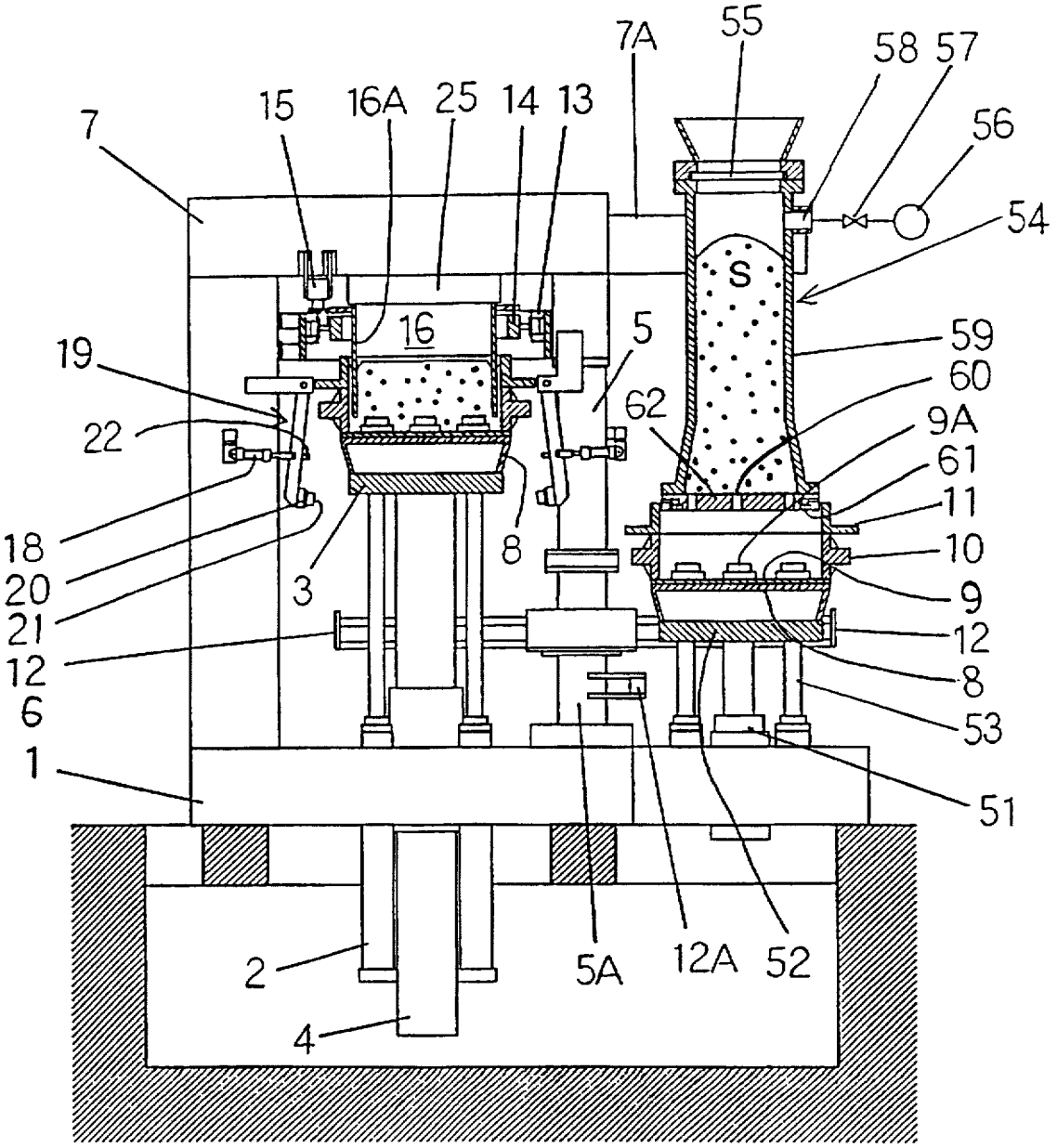
FIG. 3 is a view similar to FIG. 1, showing molding sand being pre-compacted.

During the processes of pre-compaction (FIG. 3) by the thin-plate body 16A, of pressing by the squeezing body 17A (FIG. 4), and of pattern drawing (FIG. 5), another operation is carried out. That is, the upwardly-facing cylinder 51 is activated to raise the table 52, i.e., to raise from the rotary frame 12 an assembly of a pattern plate 9, a flask 10, and a filling frame 11, to have the filling frame 11 engage the blow head 54, which holds molding sand S (FIG. 3). The valve 57 is then opened, so that the compressed air flows into the blow head 54. The compressed air and the molding sand pass through the throughbores 60 and flow into the closed space defined by the blow head and the assembly (FIG. 4). The compressed air that flowed into the space escapes from the vent holes 61. Thus molding sand is supplied into the closed space without any of it being lost. The cylinder 51 is activated to lower the raising table 52 to disengage the filling frame 11 from the blow head 54 until the assembly, which holds molding sand in it, is received by the rotary frame (FIG. 5).

The flask 10 (FIG. 5), which holds the produced mold, is moved to the roller conveyor 24, while an empty flask 10 is transferred onto the roller conveyor 19 by the roller conveyor 23. The lifter cylinders 2, 2 are then activated to raise a carrier 8 and a pattern plate 9 to have the pattern plate 9 engage the empty flask 10 and to have it engage the filling frame held by the members 22, 22 of the roller conveyor 19. The roller conveyor 19 is then opened, and the carrier 8 is lowered, so that a new assembly of the filling frame 11, flask 10, and pattern plate 9, is put on the rotary frame 12.

The frame 12 is revolved 180 degrees by actuating the rotating cylinder 12A, so that the new assembly, which is empty, is indexed below the blow head 54, while the other assembly, which holds molding sand, is indexed above the lifter table 3. During this operation the running cylinder 15 is activated to index the pre-compacting member 16 above the lifter table 3, while the gate 55 is opened to feed molding sand into the hollow cylinder 59. The entire state is shown in FIG. 1.

The above operations are repeated to produce molds.

Figure 6:
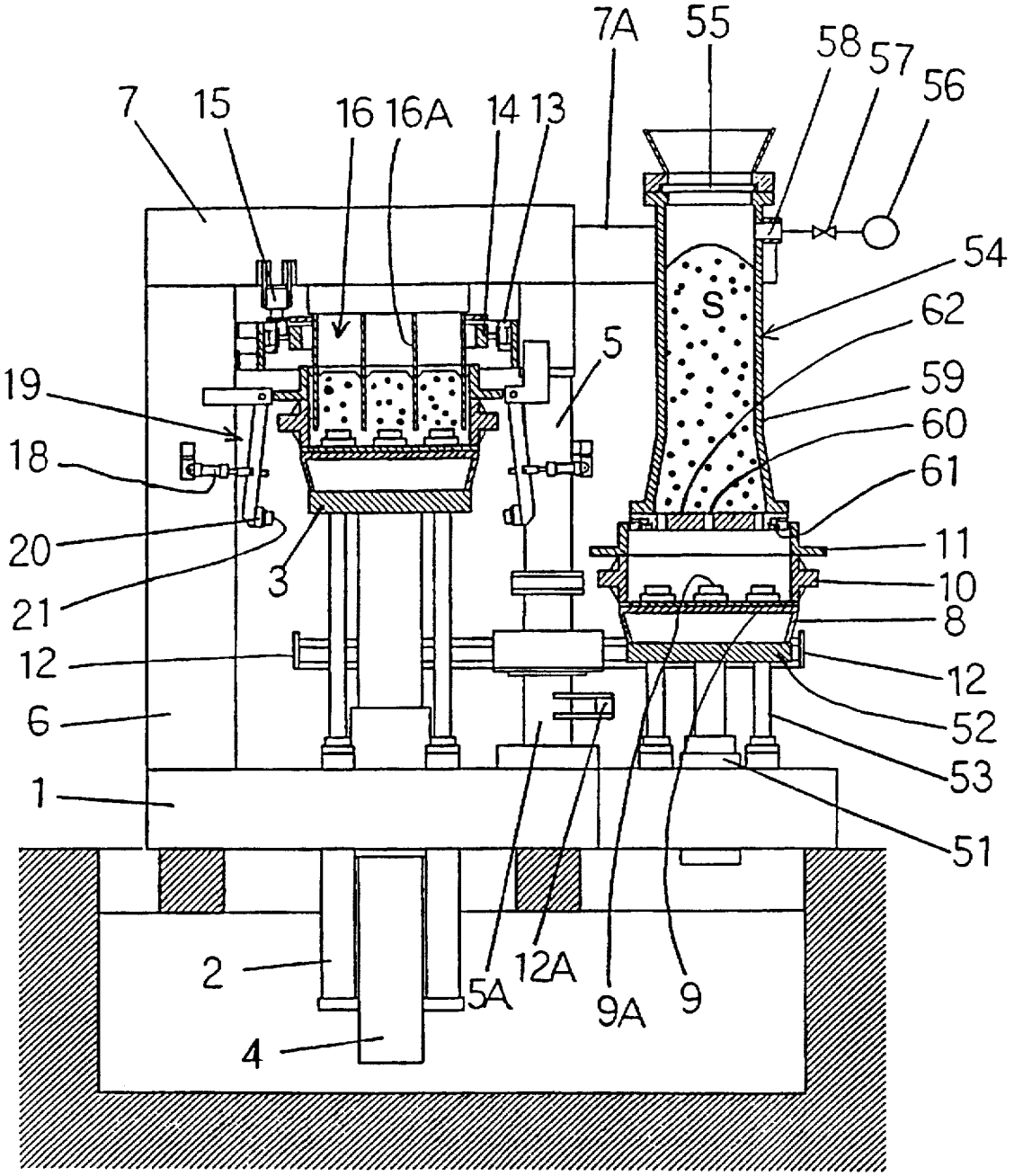
FIG. 6 is a partly cross-sectional front view similar to FIG. 3, showing an alternative thin-plate body.

FIG. 6 shows an alternative arrangement of the thin-plate body 16A. In this arrangement thin plates are disposed only near the inner and outer surfaces of the pattern 9A or near both the inner surfaces of the flask and the inner and outer surfaces of the pattern.

Figure 7:
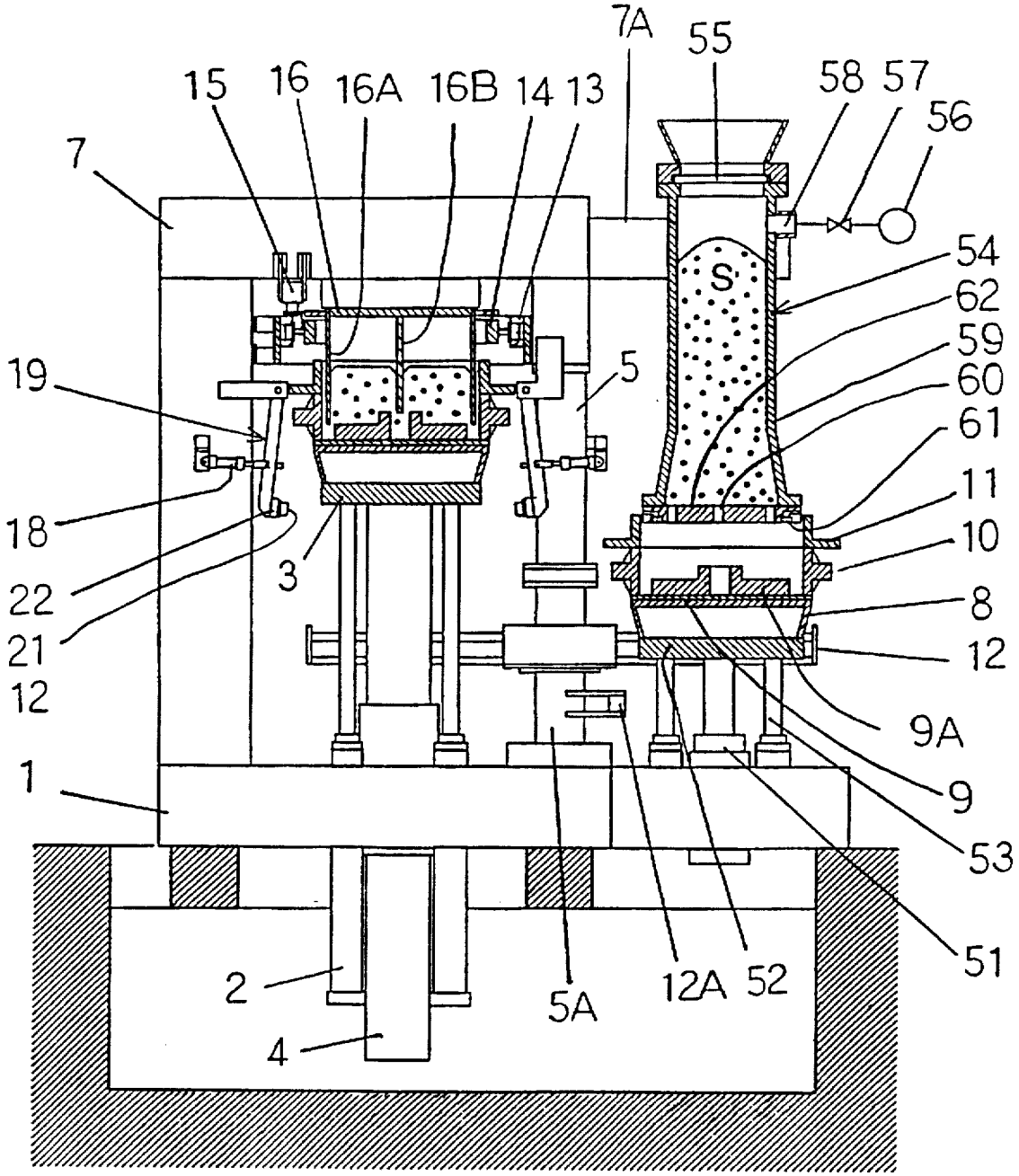
FIG. 7 is a partly cross-sectional front view similar to FIG. 3, showing an alternative pre-compacting member.

FIG. 7 shows an alternative arrangement of the pre-compacting member 17. The member also has a rod 16B, which pre-compacts the molding sand at the pocket of the pattern. As is seen from this arrangement, the member may be suitably varied to correspond to the shape and arrangement of the pattern.

Although in the above preferred embodiment a squeeze body 17A is used in the form of a plate, it may be replaced with a diaphragm squeeze head or a plurality of squeezing feet.

Although in the above preferred embodiment the raising table 52 is disposed below the blow head 54, alternatively, the raising table may be eliminated if the blow head is vertically movable. Further, the blow head may be eliminated if molding sand is fed into the flask manually or by any other conventional method.

What we claim is:

1. A molding machine for producing a mold by pressing molding sand fed into a space defined by a pattern plate and a flask, comprising:

a lifter table for lifting the pattern plate and flask which hold the molding sand; and a pre-compacting member and a pressing member disposed above the lifter table for horizontal movement and for being inserted into the flask when the lifter table lifts the flask, wherein the pre-compacting member includes a thin-plate body to be positioned slightly spaced apart from an inner surface of the flask or inner and outer surfaces of a pattern when inserted into the molding sand held in the flask, and wherein the pressing member includes a squeezing body that presses the molding sand from above.

2. The molding machine of claim 1, wherein the pre-compacting member further includes a rod.

3. The molding machine of claim 1, wherein the pre-compacting member and the pressing member are mounted on a truck which is laterally movable so that the members are selectively indexed above the lifter table.

4. A molding machine for producing a mold by feeding molding sand into a space defined by a pattern plate and a flask and by pressing the molding sand, comprising:

a blow head for feeding molding sand by compressed air into the space;

a raising table for raising the flask to engage the flask with the blow head to close the space;

a lifter table for lifting the pattern plate and flask which hold the molding sand; and a pre-compacting member and a pressing member disposed above the lifter table for horizontal movement and for being inserted into the flask when the lifter table lifts the flask, wherein the pre-compacting member includes a thin-plate body to be positioned slightly spaced apart from an inner surface of the flask or inner and outer surfaces of a pattern when inserted into the molding sand held in the flask, and wherein the pressing member includes a squeezing body that presses the molding sand from above.

5. The molding machine of claim 4, wherein the pre-compacting member further includes a rod.

6. The molding machine of claim 4, wherein the pre-compacting member and the pressing member are mounted on a truck which is laterally movable so that the members are selectively indexed above the lifter table.

7. The molding machine of claim 4, the machine further including a means for indexing the flask fed with the molding sand by the blow head above the lifter table.

8. A molding machine for producing a mold by feeding molding sand into a space defined by a pattern plate and a flask and by pressing the molding sand, comprising:

a vertically movable blow head for closing the space and for feeding molding sand by compressed air into the closed space;

a lifter table for lifting the pattern plate and flask which hold the molding sand; and a pre-compacting member and a pressing member disposed above the lifter table for horizontal movement and for being inserted into the flask when the lifter table lifts the flask, wherein the pre-compacting member includes a thin-plate body to be positioned slightly spaced apart from an inner surface of the flask or inner and outer surfaces of a pattern when inserted into the molding sand held in the flask, and wherein the pressing member includes a squeezing body that presses the molding sand from above.

9. The molding machine of claim 8, wherein the pre-compacting member further includes a rod.

10. The molding machine of claim 8, wherein the pre-compacting member and the pressing member are mounted on a truck which is laterally movable so that the members are selectively indexed above the lifter table.

11. The molding machine of claim 8, the machine further including a means for indexing the flask fed with the molding sand by the blow head above the lifter table.

* * * * *